United States Patent [19]

Hildebrandt et al.

[11] 4,114,268

[45] Sep. 19, 1978

[54] SHEARS WITH IMPROVED LATCH FOR HANDLES

[75] Inventors: William J. Hildebrandt, West Simsbury; Richard H. Rathbun, Oakdale, both of Conn.

[73] Assignee: The Stanley Works, New Britain, Conn.

[21] Appl. No.: 847,698

[22] Filed: Nov. 2, 1977

[51] Int. Cl.[2] ..... B26B 13/16

[52] U.S. Cl. ..... 30/262

[58] Field of Search ..... 30/261, 262; 81/367, 81/368

[56] References Cited

U.S. PATENT DOCUMENTS

| | | | |
|---|---|---|---|
| 3,235,964 | 2/1966 | Young | 30/262 |
| 3,357,267 | 12/1967 | Wetepny | 30/262 X |
| 3,869,793 | 3/1975 | Ferguson | 30/262 |
| 4,074,597 | 2/1978 | Jansson | 30/261 |

*Primary Examiner*—Jimmy C. Peters

[57] ABSTRACT

A releasable latch is provided upon the handles of a pair of relatively pivotable operating members which are normally biased apart by spring means. The latch comprises opposed arm members on the handles which in part overlie each other with one of the arm members having a latch aperture and the other having a latch post extending into the latch aperture. One arm member is provided with an integral hinge portion, and the latch post has a shoulder thereon which engages with a cooperating shoulder surface on the other arm member about the latch aperture therein. The spring means biases the handles apart so as to maintain the cooperating shoulders in engagement in the closed position. One or both of the latch post and latch aperture is desirably provided with a cam surface to move the latch post within the latch aperture into a position wherein the cooperating shoulder surfaces will engage. Conveniently, these camming surfaces are provided by an inclined buttress portion on the latch post forming a generally key-shaped cross section therefor and a cooperating inclined surface on the wall defining the latch aperture so that the cross section thereof is of generally keyhole configuration.

9 Claims, 13 Drawing Figures

SHEARS WITH IMPROVED LATCH FOR HANDLES

BACKGROUND OF THE INVENTION

Various hand tools employ operating members which are pivotably assembled, and some of these utilize springs to bias the handles apart so that the user closes the jaws by applying clamping pressure to the handles. In order to maintain the jaws and handles in a closed position for storage and for preventing injury to any of the working surfaces thereof, as well as possible injury to users of the tool during transport or storage thereof, various latches have been devised to maintain the handles in a closed position.

Frequently, such latches employ separate elements which are mounted upon the handles in a manner permitting pivotal movement of one or both thereof. In some instances, a projection may be integrally formed in one of the handles and a separate latch mounted upon the other of the handles for pivoting into engagement with the shoulder as, for example, in Koblick Design U.S. Pat. No. 238,650 granted Feb. 3, 1976; Stevenson Design U.S. Pat. No. 239,080 granted Mar. 9, 1976; and Streight U.S. Pat. No. 803,796 granted Nov. 7, 1905.

With the advent of sythetic resins such as polypropylene and propylene polyallomers providing integral self-hinging characteristics, there have been recent efforts to provide latches wherein both elements are integrally formed from the synthetic resin of the handle members. Illustrative of such a structure is Ferguson U.S. Pat. No. 3,869,793 granted Mar. 11, 1975.

It is an object of the present invention to provide a hand tool such as shears and the like employing a novel and highly effective latch assembly wherein the components thereof are integrally formed with synthetic resin handles and wherein such components may be readily engaged and disengaged.

It is also an object to provide such a hand tool wherein the components of the latch assembly are rugged and durable and may be readily fabricated at the time of molding of the synthetic resin handles.

Another object is to provide such a hand tool wherein pivoting of one latch component relative to the other produces a camming movement to effect the latching and wherein additional movement of the handles in the closing direction will disengage the latch assembly.

SUMMARY OF THE INVENTION

It has now been found that the foregoing and relating objects may be readily attained in a hand tool having a pair of operating members formed with jaw portions at one end thereof and pivotably assembled by pivot means so as to provide for pivotal movement of the jaw portions towards each other into a closed position and away from each other into an open position. Synthetic resin handle members are affixed to the other end of each of the operating members for gripping by the user to effect the desired pivotal movement between open and closed positions, and spring means is operatively connected between the operating members to bias them into the open position. Releasable latch means is integrally formed on the handle members to maintain the operating members in the closed position, and such latch means comprises opposed arm members adjacent the outer ends of the handle members which extend generally perpendicularly to the longitudinal axis of the handle members and into overlying relationship. One of the arm members has a latch apertue extending therethrough which is spaced inwardly from its free end and the other arm member has a latch post which projects from its surface adjacent the first mentioned arm member and into the latch aperture thereof. Either arm member is provided with an integral hinge portion adjacent the body of its handle member which permits pivotal movement of its outer end portion towards and away from the other arm member to permit insertion and removal of the latch post from the latch aperture. The latch post has a laterally extending shoulder spaced inwardly from its outer end which is engaged with a cooperating shoulder surface on the other arm member about its latch aperture. The biasing pressure of the spring means operates to maintain these cooperating shoulder portions in engagement in the closed position of the operating member.

In accordance with the preferred embodiment of the hand tool, the cooperating shoulder surface on the first mentioned arm member is provided by an enlarged portion in the latch aperture adjacent its outer end. The latch post is configured to provide a camming surface on its face opposite its latching shoulder, and this camming surface is inclined from adjacent the outer end of the post to an increased width adjacent its base; as a result, relative pivotal movement of the latch post into the latch aperture tends to move the latch post towards the cooperating shoulder surface of the other arm member.

As an alternative to the incllined surface on the latch post, or in combination therewith, the wall defining the latch aperture opposite its cooperating shoulder surface may be inclined from the inner end thereof to the outer end thereof in the direction of the cooperating shoulder surface, and this will tend to move the latch post towards the cooperating shoulder surface upon insertion of the latch post into the latch aperture. As indicated above, the most desirable structures are those in which both camming surfaces are provided and cooperate with each other.

A particularly useful configuration is one in which the latch post is of key-shaped cross section with the linear portion comprising a buttress with an inclined edge surface functioning as the camming surface. Similarly, the latch aperture is of generally keyhole cross section so as to cooperate with the key-shaped cross section of the latch post.

DETAILED DESCRIPTION OF THE ILLUSTRATED EMBODIMENT

Figure 1:
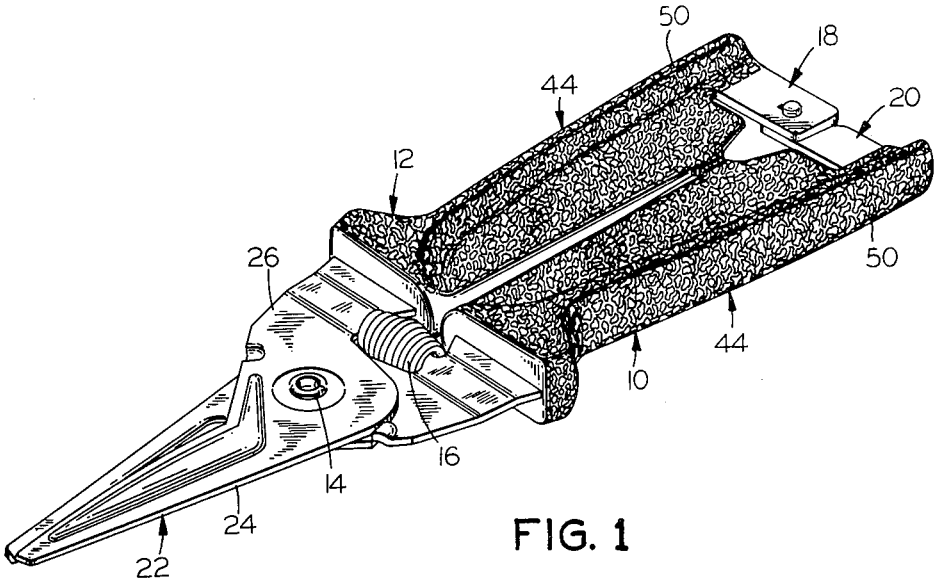
FIG. 1 is a perspective view of shears embodying the improved latch for the handles.

Turning now in detail to the attached drawings, shears or snips embodying the present invention are illustrated in FIGS. 1–7 and are comprised of the operating members generally indicated by the numerals 10,12 which are pivotable relative to each other about the pivot pin or rivet 14. The compression spring 16 normally biases the operating members apart into the position shown in FIG. 7 and the operating members 10,12 may be secured in the closed position of FIGS. 1–3 by means of a latch assembly including the latch member on the operating member 12 generally designated by the numeral 18 and the latch post member on the operating member 10 generally designated by the numeral 20.

Figure 8:
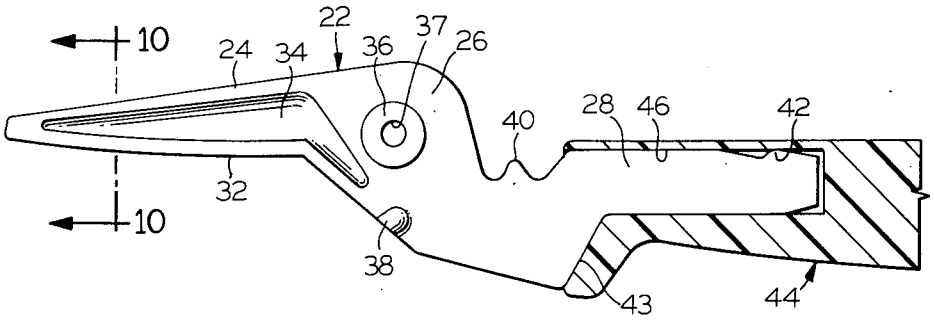
FIG. 8 is a fragmentary plan view of one of the operating members with a portion of the handle in section to reveal internal construction.

In FIG. 8 there is illustrated one of the operating members 10,12 since the two members are identical with the exception of the latch members 18,20. Each operating member 10,12 is comprised of a sheet metal blade member generally designated by the numeral 22 and a synthetic resin handle member generally designated by the numeral 44.

Turning first in detail to the construction of the blade member 22, it is conveniently stamped from sheet metal so as to provide at one end a blade portion 24 tapering to a reduced width at its outer end, an intermediate pivot portion 26, and a handle portion or tang 28 extending from the pivot portion 26 to the side of the pivot aperture 37 therein opposite from the blade portion 24. The blade portion 24 is provided with an arcuate cutting edge 32 and a reinforcing rib or boss 34 of generally L-shaped configuration is formed in the metal somewhat inwardly from the cutting edge 32 and the adjacent edge surface of the pivot portion 26. In the assembled structure, the bosses 34 of the cooperating blade members 22 project oppositely from each other so as not to interfere with the cutting action of the blade portions 24.

A circular boss 36 is provided about the pivot aperture 37 and extends in the opposite direction from the reinforcing boss 34 so that, in the assembled structure, the raised bosses 36 of the two cooperating blade members 22 will function as the bearing surfaces therefor. In addition, the pivot portion 26 is provided with a stop boss 38 along the same side as the cutting edge 32 and which limits pivotal movement of the other operating member 10,12 to the blade open position in response to the biasing action of the spring 16. The stop boss 38 projects in the same direction as the reinforcing boss 34, and the outer edge of the other operating member 10,12 will abut the edge of the upstanding stop boss 38.

Along the edge of the handle portion on the opposite side from the blade cutting edge 32, there is provided a spring guide projection 40 adjacent the pivot portion 26 and a recess adjacent the end thereof providing a locking shoulder 42 for a purpose to be described more fully hereinafter. This edge of the handle portion 28 extends substantially in alignment with the cutting edge 32, and the configuration of the handle portion 28 is such that the opposite edge thereof initially extends to a substantial spacing from the first mentioned edge and then tapers inwardly to provide an abutment shoulder 43 and a terminal handle portion of substantially lesser width.

Figure 2:
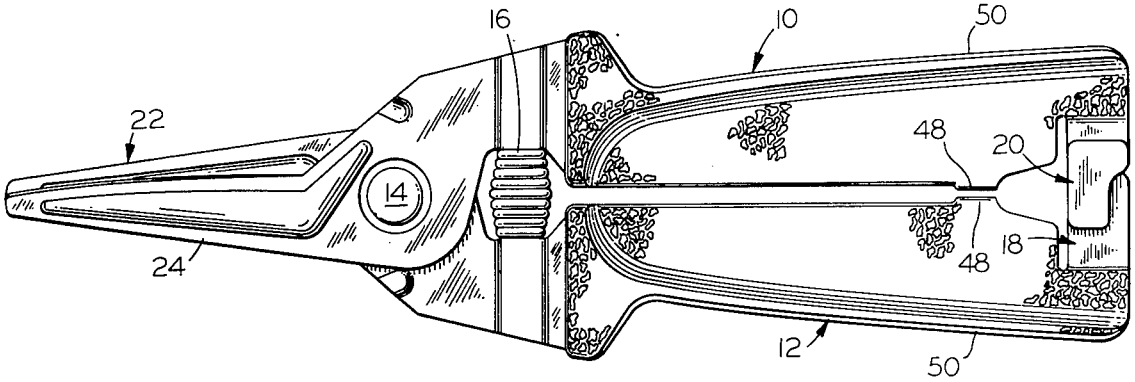
FIG. 2 is a top plan view thereof.
Figure 3:
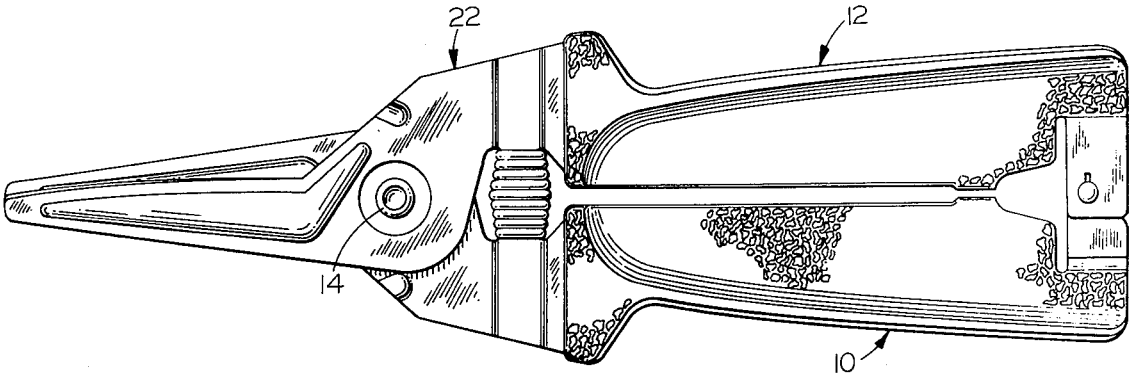
FIG. 3 is a bottom view thereof.
Figure 4:
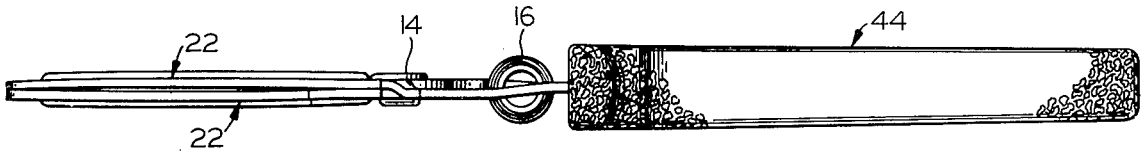
FIG. 4 is a side elevational view thereof.
Figure 5:
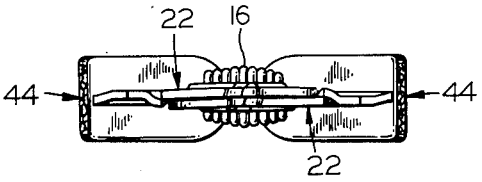
FIG. 5 is an end elevational view of the blade end thereof.
Figure 6:
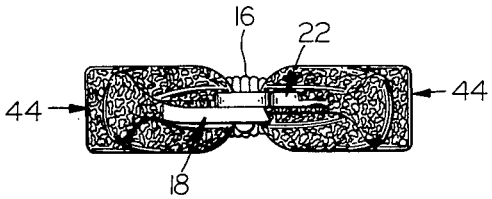
FIG. 6 is an end elevational view of the handle end thereof.
Figure 7:
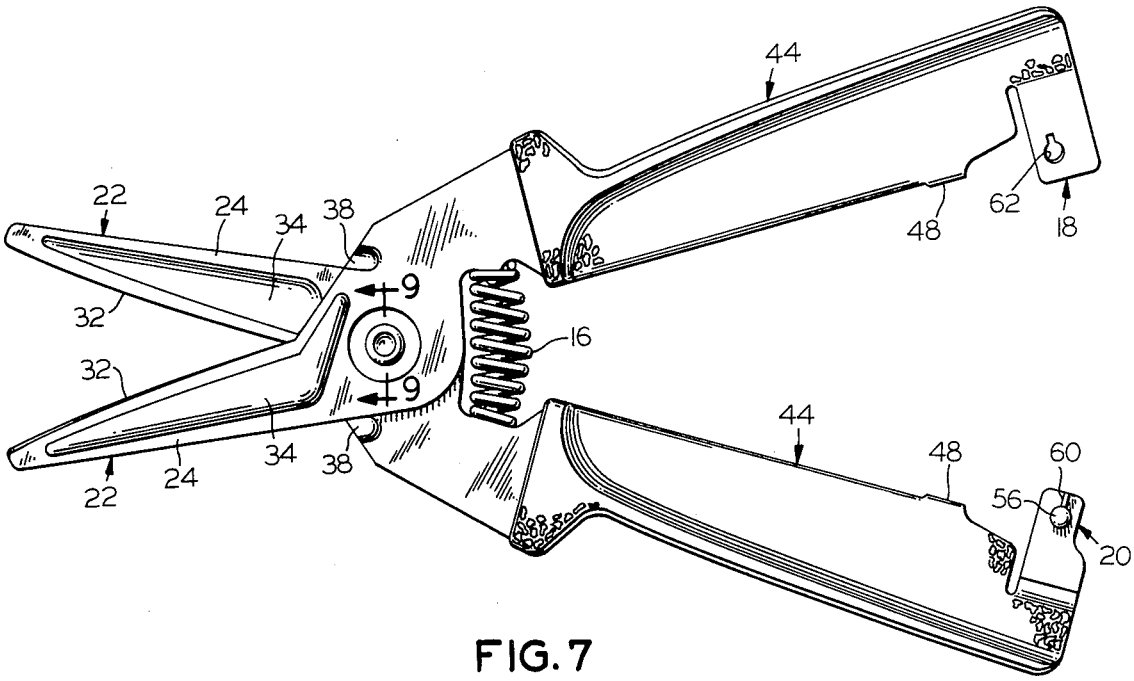
FIG. 7 is a plan view with the blades and handles in the biased open position.

The synthetic resin handles 44 are of generally L-shaped configuration and have cavities 46 therein of generally rectangular cross section to seat the handle portions 28 of the blade members 22. As seen in FIG. 8, the cavities 46 have an outwardly tapering portion adjacent the opening therein to provide a surface abutting the abutment shoulder 43 of the blade member 22 when the blade members 22 are driven into the cavities 46. Moreover, locking shoulder 42 on the handle portion 28 of the blade members 22 will tend to embed itself in the syntheteic resin of the handle 44 so as to prevent disengagement after assembly. As seen in FIGS. 1–3, the handles 44 are of greater thickness along their outer side margins to provide ribs 50 of increased surface area for gripping by the hand of the user. On the adjacent edges of the handles 44 are laterally projecting and aligned projections or stops 48 which limit closing movement thereof.

One of the handles 44 is formed to provide the latch post member 20 which is best seen in FIGS. 6, 7, 12 and 13. The latch post member 20 extends laterally from the outer end of the handle 44 perpendicularly to the longitudinal axis of the handle 44 and includes at its free end a relatively thick body portion 52 connected to the body of the handle 44 by a reduced thickness hinge portion 54. Projecting upwardly from the body portion 52 is the latch post generally comprised of the cylindrical post portion 56 and the buttress portion 60 which is inclined from adjacent the upper end of the cylindrical post portion 56 to the free edge of the body portion 52. The cylindrical portion 56 is undercut on its surface opposite the buttress 60 to provide a shoulder 58.

Figure 13:
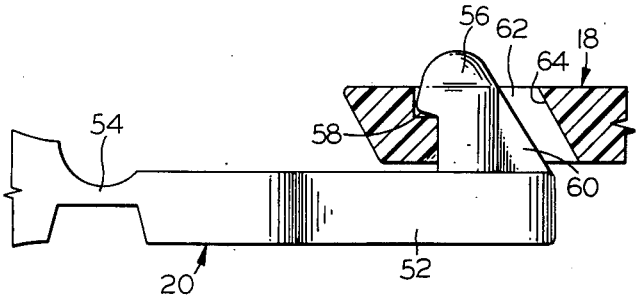
FIG. 13 is a fragmentary sectional view to the same scale showing the handles as latched.

The other handle 44 is configured to provide the latch member 18 which comprises a lateral arm extending perpendicularly to the longitudinal axis of the handle to overlie the body portion 52 of the latch post member 20 and having a keyhole shaped aperture 62 adjacent its free end. The linear portion of the aperture 62 is dimensioned and configured to cooperate with the butress portion 60 of the latch post and has a cooperatively tapering surface 64. The circular portion of the aperture 62 opposite the linear portion has an enlarged portion adjacent the outer surface to provide a shoulder 66 which cooperates with the shoulder 58 on the cylindrical post 56 for effecting latching action as seen in FIG. 13.

Figure 10:
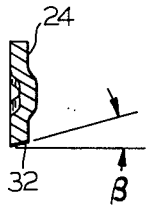
FIG. 10 is a sectional view to an enlarged scale along the line 10—10 of FIG. 8.
Figure 11:
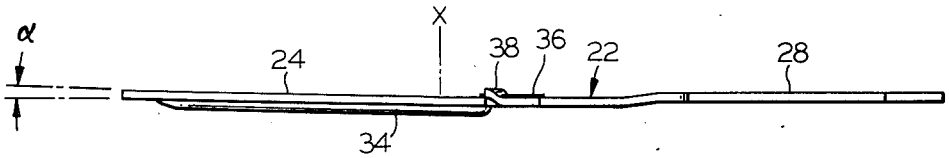
FIG. 11 is a side elevational view to an enlarged scale of one of the blade members with construction lines included to indicate the angular disposition of the blade portion.
Figure 12:
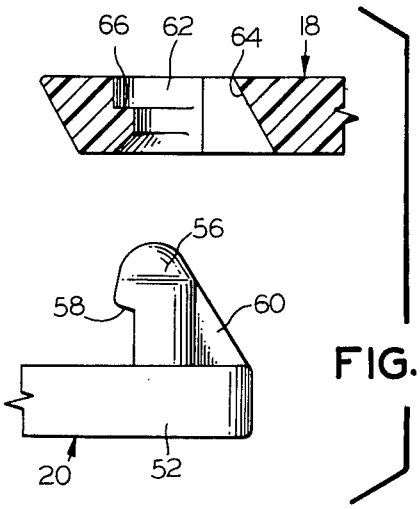
FIG. 12 is a fragmentary exploded view to a greatly enlarged scale of the latch portion of the handles.

As seen in FIG. 10, the cutting edge 32 is ground so as to provide a rake angle beta which is highly desirable to provide clearance to facilitate cutting by the edge 32 through various materials. As seen in FIG. 11, the tendency for the relatively flexible blade portions 24 to deflect apart during cutting action is compensated by inclining the blade portion 24 from the plane of the pivot portion 26 and handle portion 28 in the direction of the cooperating blade member 22. The angle of incline from the point X representing the inner end of the cutting edge 32 to the outer end of the blade portion 24 is represented by the angle alpha. Since the two blade portions 24 are inclined towards each other, there is a constant biasing pressure operating at the point of contact of the cutting edges 32 which ensures the desired wiping action of the blade portions adjacent the point of cutting.

In operation of the shears, the latch post member 20 is disengaged from the latch member 18 by pressing the handles 44 towards each other which causes the sloping surface of the buttress portion 60 of the latch post to bear against the tapered surface 64 of the latch aperture 62 as operating members 10,12 are pivoted somewhat about the pivot 14. This produces a camming action causing the latch post to be cammed outwardly and downwardly relative to the latch aperture 62. Thus, when the clamping pressure on the handles 44 is released, the operating members 10,12 will spring apart towards the open position shown in FIG. 7.

The material to be cut (not shown) is introduced into the space between the cutting edges 32, and the user then applies closing pressure to the handles 44 which concurrently brings the blade portions 24 towards each other. Because of the configuration of the cutting edges 32 and the wiping action produced by the angular offset of the blade portion 24, the material will be cut at the point of contact without any substantial tendency for the material to be pushed outwardly by the cutting action. Moreover, the rake angle of the cutting edge 32 will provide the clearance necessary for effective cutting action of substantially all materials. Upon completion of the cutting stroke, the user releases the clamping pressure upon the handles 44 and the blade portions 24 again spring into a position to effect the next cut.

When cutting has been completed and it is desired to latch the handles 44, they are moved towards each other until the stops 48 abut or substantially abut, at which point the latch post member 20 overrides the latch member 18. The user may then press downwardly upon the latch post member 20 while at the same time releasing some of the closing pressure, and this will cause pivoting of the post member 20 about the hinge portion 54 and entry of the cylindrical post 56 into te keyhole aperture 62. As the cylindrical post 56 moves downwardly into the aperture 62, the camming action produced by the tapered surface 64 of the aperture and the tapered surface of the buttress portion 60 causes the post 56 to move in the opposite direction until the shoulder 58 and shoulder 66 enter into latching engagement, at which point all closing pressure may be removed from the handles 44.

In fabricating and assembling the shears of the present invention, the blade members 22 are conveniently stamped and punched from sheet metal into the desired configuration, heat treated and then subjected to a grinding operation to provide the rake angle beta along the cutting edge 32. The handles 44 are molded into the desired configuration and affixed to the blade members 22 by inserting and driving the handle portions 28 thereof into the cavities 46 of the handles 44. As previously indicated, the locking shoulder 42 will tend to imbed itself in the synthetic resin of the handle 44 defining the wall of the cavity 46 to prevent subsequent disengagement. If so desired, adhesive engagement may also be provided by an adhesive coating, heat sealing or other means, or physical interlocking may be increased by providing recesses or apertures in the handle portion 28 into which synthetic resin from the handles 44 may be caused to flow. Moreover, an alternate method of assembly may involve the forming of the handles 44 from molten resin about the previously formed handle portions 28.

Figure 9:
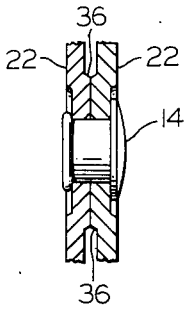
FIG. 9 is a fragmentary sectional view to an enlarged scale along the line 9—9 of FIG. 7.

Following assembly of the handles 44 to the blade members 32 to form the operating members 10,12 these members are then pivotably engaged by inserting the pivot pin or rivet 14 through the aligned apertures 37 and staking the shank thereof as seen in FIG. 9. The compression spring 16 is seated about the spring guide 40 of one of the handle portions 28, compressed, and then slipped over the spring guide 40 of the other handle portion 28. For shipping purposes, the latch post member 20 is engaged in the latch member 18 to complete the assembly as shown in FIGS. 1–6.

The synthetic resin employed for the handles should be one providing self-hinging properties such as polypropylene or ethylene/propylene polyallomers. The handles may be fabricated by injection molding, centrifugal molding, or any other suitable technique. The blade members are most desirably fabricated from stainless steel to permit their use for many cutting applications including foods and the like.

Although the hinged portion has been provided upon the pivot post member in the illustrated embodiment, it may be provided on the apertured latch member if so desired.

It may be appreciated that the overall configuration and dimensioning of the blade members may vary considerably from that illustrated in the drawings and that multiple corrugations or ribs may be employed to provide the desired stiffness in the sheet metal blade members.

The cutting edge of the blade members preferably employes a arcuate configuration providing a constant cutting angle as more fully described and claimed in the copending application of William J. Hildebrandt entitled SHEARS WITH IMPROVED CUTTING ACTION AND METHOD OF MAKING SAME, filed Nov. 2, 1977 and bearing Ser. No. 847,697.

As will be appreciated, the latch mechanism of the present invention may be used in connection with hand tools other tan shears and which employ pivotable operating members wherein the handles and jaws are normally biased apart by spring means. Exemplary of such other tools are pliers, tool retrieving clamps, and the like.

From the foregoing detailed specification and claims, it will be readily apparent that the shears of the present invention employ a novel and highly effective latch assembly integrally formed with the synthetic resin handles. Moreover, the latch assembly is one which is rugged and durable and yet easily operable for both closing and opening thereof. The dimensions of the latch components may be varied as required to increase the strength or holding capabilities of the latch assembly depending upon the size of the tool for which employed and the opening pressures to be resisted.

Having thus described the invention, we claim:

1. A hand tool comprising:

A. a pair of operating members each having jaw portions at one end thereof;

B. pivot means pivotably assembling said operating members for pivotal movement of said jaw portions towards each other into a closed position and away from each other into an open position;

C. synthetic resin handle members affixed to the other end of said operating member for gripping by a user to effect said pivotal movement thereof;

D. spring means operatively connected between said operating members and biasing said operating members into the open position thereof; and E. releasable latch means integrally formed on said handle members to maintain said operating members in said closed position, said latch means comprising opposed arm members adjacent the outer ends of said handle members extending generally perpendicularly to the longitudinal axis of said handle members into overlying relationship, one arm member having a latch aperture therethrough spaced inwardly from the free end thereof and the other of said arm members having a latch post projecting from the surface thereof adjacent said one arm member and into said latch aperture thereof, either one of said arm members having an integral hinge portion adjacent the body of the handle member thereof permitting pivotal movement of the outer end portion thereof towards and away from the other one of said arm members for insertion and removal of said latch post from said latch aperture, said latch post having a laterally extending shoulder spaced inwardly from the outer end thereof engaged with a cooperating shoulder surface of said one arm member about said latch aperture, said biasing pressure of said spring means operating to maintan said cooperating shoulders in engagement in the closed position of said operating members.

2. The hand tool in accordance with claim 1 wherein said cooperating shoulder surface of said one arm member is provided by an enlarged portion of said latch aperture adjacent the outer end thereof.

3. The hand tool in accordance with claim 1 wherein said latch post is configured to provide a camming surface on the face thereof opposite said shoulder and tapering from adjacent the outer end of said post to an increased width adjacent the base thereof, said camming surface tending to move said latch post towards the cooperating shoulder surface of said one arm member upon relative movement of said latch post into said latch aperture.

4. The hand tool in accordace with claim 1 wherein the wall defining said latch aperture in said one arm member opposite said cooperating shoulder surface is inclined from the inner end thereof to the outer end thereof in the direction of said cooperating shoulder surface to move said latch post towards the cooperating shoulder surface of said one arm member upon relative movement of said latch post into said latch aperture.

5. The hand tool in accordance with claim 1 wherein said latch post is configured to provide a camming surface on the face thereof opposite said shoulder tapering from adjacent the outer end of said post to an increased width adjacent the base thereof, and wherein said latch aperture has a cooperatively dimensioned and configured inclined surface, whereby said cooperating surfaces function to cam the latch post towards the cooperating shoulder surface of said one latch member upon relative pivotal movement of said latch post into said latch aperture, said cooperating surfaces also serving to cam said latch post outwardly of said latch aperture upon movement of said handle members towards each other.

6. The hand tool in accordace with claim 3 wherein said camming surface on said latch post is provided by a tapered buttress portion extending towards the free end of said other arm member to provide a substantially key-shaped cross section.

7. The hand tool in accordace with claim 5 wherein said camming surface on said latch post is provided by a tapered buttress portion extending towards the free end of said other arm member to provide a substantially key-shaped cross section and wherein said latch aperture has a cooperatintively dimensioned and configured inclined surface to provide a generally keyhole cross section.

8. The hand tool in accordance with claim 7 wherein said cooperating shoulder surface of said latch member is provided by a enlarged portion of said latch aperture adjacent the outer end thereof.

9. The hand tool in accordance with claim 1 wherein the arm member having said integral hine portion is said other arm member having said latch post.

* * * * *